United States Patent [19]

Chen et al.

[11] Patent Number: 4,784,317

[45] Date of Patent: Nov. 15, 1988

[54] ONE PIECE MAILER FOR LASER PRINTER

[75] Inventors: Tien-Tsung Chen, Claremont; Ghanshyam H. Popat, Alta Loma; Stephanie A. Streeter, Pacific Palisades, all of Calif.

[73] Assignee: Avery International Corporation, Pasadena, Calif.

[21] Appl. No.: 64,074

[22] Filed: Jun. 17, 1987

[51] Int. Cl.[4] ..... B65D 27/04; B65D 27/14

[52] U.S. Cl. ..... 229/92.3; 229/70

[58] Field of Search ..... 229/70, 92.3

[56] References Cited

U.S. PATENT DOCUMENTS

| | | | |
|---|---|---|---|
| 1,310,188 | 7/1919 | Hogan | 229/70 |
| 3,467,299 | 9/1969 | Meyer | 229/70 |
| 3,701,468 | 10/1972 | Steinhauser | 229/70 |
| 3,802,618 | 4/1974 | Wiessner | 229/71 |
| 3,937,492 | 2/1976 | Biron | 229/92.3 |

FOREIGN PATENT DOCUMENTS

| | | | |
|---|---|---|---|
| 691965 | 8/1964 | Canada | 229/70 |

*Primary Examiner*—Stephen P. Garbe

*Attorney, Agent, or Firm*—Poms, Smith, Lande & Rose

[57] ABSTRACT

A one piece mailer for use in laser printers or xerographic copying machines includes a standard size sheet which may be employed in laser printers or xerographic machines without special handling equipment and involves printing on one side only of the mailer. In addition, stable adhesive material is employed for sealing the one piece mailer which will not run or contaminate the office machines, when it is subject to several hundred degrees heat. This adhesive is preferably a water-activated adhesive other than natural gum (which is heat-activated). The first embodiment of the invention includes a mailing sheet having an upper and lower half, with the upper half carrying the addresses and the message, and the lower half having windows which match the location of the addresses on the upper half of the mailer. The second embodiment of the invention involves a mailer having a first full sheet having an upper portion on which the messages are printed, and a lower portion on which the addresses are printed. On the rear side of the main sheet is a short partial sheet toward the bottom of the main sheet forming an envelope, and with a transverse strip of adhesive immediately above the envelope pocket to seal the envelope. Perforations extend across the main sheet just above the adhesive-coated strip, so that the message section may be separated from the envelope portion, and the message portion folded and placed within the envelope, and the envelope sealed.

21 Claims, 3 Drawing Sheets

ONE PIECE MAILER FOR LASER PRINTER

FIELD OF THE INVENTION

This invention relates to one piece mailers for use under adverse heat and moisture conditions.

BACKGROUND OF THE INVENTION

Laser printers are becoming more widely used in business correspondence, in combination with computer terminals. One serious disadvantage of laser printers, however, is that it is not easy to address envelopes. Accordingly, many offices must necessarily have both available typewriters for addressing envelopes. To avoid this problem, it would be convenient to use one piece mailers in which the address and the message were both printed onto the one piece mailer by the laser printer. However, one piece mailers normally have natural gum adhesive for closing the mailer and forming it into an envelope. Unfortunately, this type of natural gum adhesive is heat-activated and will contaminate the operative mechanisms of many laser printers or xerographic copiers.

Accordingly, a principal object of the present invention is to overcome the problems outlined hereinabove.

SUMMARY OF THE INVENTION

In accordance with one embodiment of the invention, a one piece mailer is formed of a single sheet of paper, which may for example, be 8½ inches by 11 inches, or up to 8½ by 14 inches in length, and the addresses and message are typed on the upper one-half of the sheet, which is a continuous, single thickness sheet. The lower half of the sheet is provided with two windows, so that when the sheet is folded in half, the addresses from the upper portion of the sheet are visible through the windows. Incidentally, the upper portion of the sheet includes defined areas or boxes where the name and address of the sender and the addressee are to be located, so that they match the positioning of the windows in the lower half of the sheet. In addition, the lower edge of the lower half of the sheet is provided with a strip of stable, moisture or water-activated adhesive to permit sealing of the one piece mailer to form an envelope, when the mailer is folded in two. The two sides of the lower half of the mailer may also be provided with a stable, water-activated adhesive for completely sealing the envelope.

It is important that the water-activated adhesive not be conventional "natural" gum, as this type of adhesive becomes sticky with the few hundred degrees of heat encountered in a laser printer of xerographic machine, and the sticky, heated natural gum would then contaminate these office machines.

Instead of a stable, water-activated adhesive similar to a gum, the adhesive along the edge or edges of the lower half of the sheet may be a stable, pressure-sensitive adhesive covered with the usual strip of release coated protective paper so that, when it is desired to close the envelope, the strip of protective paper is removed and the mailer is folded up. The pressure-sensitive adhesive must be of a type which will not flow under a temperature of a few hundred degrees, and may be spaced slightly back from the edges of the area where it is to be located.

In accordance with another embodiment of the invention, the mailer may be formed of one full sheet of paper of the sizes mentioned hereinabove, with the printing to be applied on a front side of the sheet, and no printing on the back side thereof. In addition, on the lower end or portion of the imprinted back side of the sheet, an additional partial sheet of paper is provided and secured to the main upper sheet to form an envelope. Further, a strip of adhesive extends along the top of the partial sheet, with perforations immediately above the strip of adhesive. A letter would then be printed on the upper portion of the front of the main sheet of the mailer, and at the same time, addresses would be printed onto the envelope portion of the mailer, on the lower part of the front side thereof. Following printing, the message portion of the mailer would be separated from the envelope along the perforations, folded up, and inserted into the envelope, and sealed. Again, the adhesives employed would be of the stable types discussed hereinabove, which would not contaminate the laser printer or xerographic copying machines.

It may be noted that in both embodiments of the invention as discussed hereinabove, the leading or top half of the mailer is only a single continuous sheet of paper, and includes no windows or adhesive material. In this regard, it has been determined that the presence of windows or other significant irregularities in the leading edge of the mailer will tend toward jamming the office machines. It may also be noted that in both embodiments of the invention, only one side of the mailer is printed, and the other side of the mailer needs no printing. Accordingly, the mailer is only processed through the laser printer or the copier machine once.

Other ojects, features, and advantages of the invention will become apparent from a consideration of the following detailed description and from the accompanying drawings.

DETAILED DESCRIPTION

Figure 1:
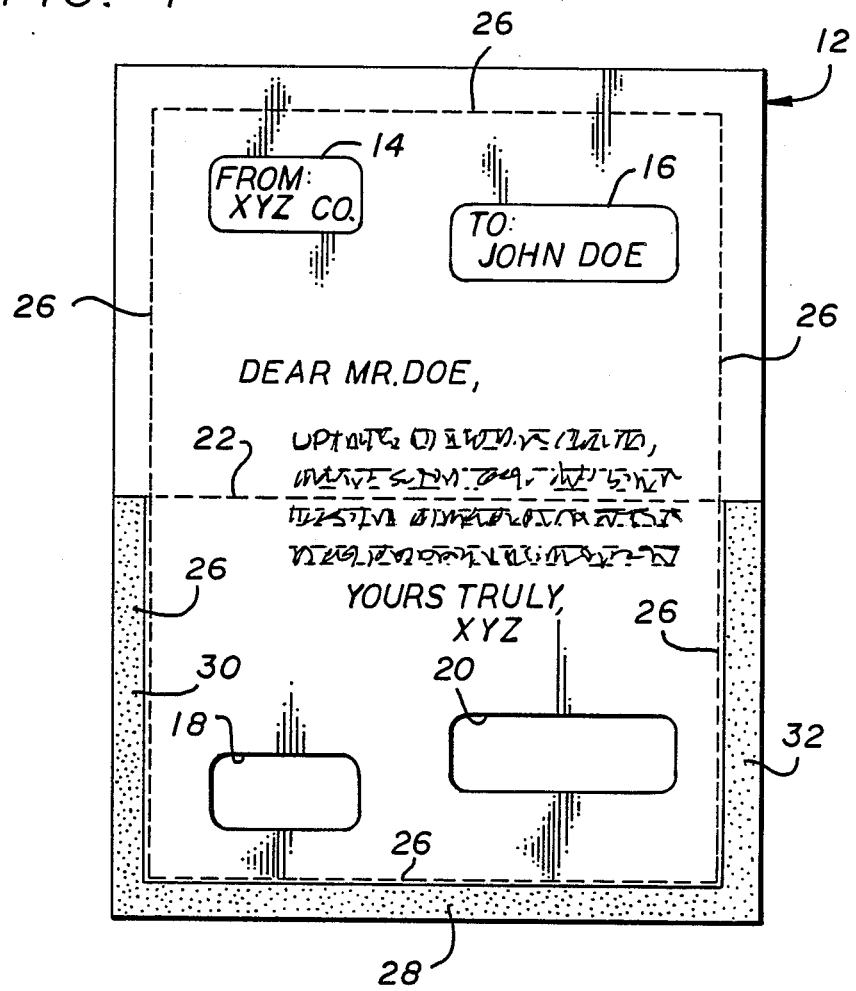
FIG. 1 is a front view of a one piece mailer in which the message is to be written on the upper portion of the mailer, and the lower portion of the mailer includes windows through which the addresses are visible.
Figure 2:
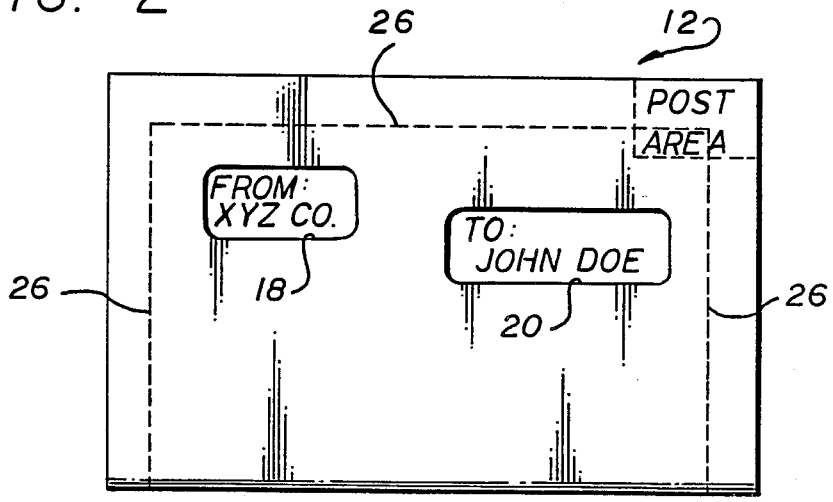
FIG. 2 shows the one piece mailer of FIG. 1 following sealing of the mailer.

Referring more particularly to the drawings, FIG. 1 shows a one piece mailer 12 for use with laser printers or xerographic copying machines. The one piece mailer includes marked areas or boxes 14 and 16 for printing the sender's name and address, and that of the addressee, respectively. In addition, windows 18 and 20 are provided, so that, when the one piece mailer 12 is folded about its horizontal center line indicated by dashed lines 22, the addresses of the sender and the addressee appear through the windows, as indicated in FIG. 2. More specifically, with reference to FIG. 2 it may be noted that the sender's name and address from the block 14 in FIG. 1 appears through the window 18, and the addressee's name and address from the area 16 of FIG. 1 appears in the window 20.

Now, returning to FIG. 1, the outer periphery of the mailer 12 may be perforated along the lines 26 for ease in opening the one piece mailer following receipt.

The lower edge of the mailer 28 is coated with a stable, water-activated, or moisture-activated adhesive which is not significantly affected by either hear or exposure to high humidity. In this regard, it is noted that so-called "natural" gum adhesives are not suitable for this purpose, as the relatively high heat of a few hundred degrees to which the paper is subject in a laser printer or by the hot rollers of a xerographic copying machine, will produce contamination to the printer or copier from adhesives such as natural gum. There are known adhesives which are moisture activated and are relatively stable in that they are not activated by temperatures of a few hundred degrees, or relatively high humidity conditions. One such adhesive is available from Adhesives Consultants Corporation, 25817 Clawiter Road, Hayward, Calif. 94545, under the trade name "Adcon FS-6". This adhesive is a polyvinyl emulsion. As noted above, other stable moisture-activated adhesives are known, and such other adhesives may be employed.

If desired, the side areas 30 and 32 may also be coated with the same type of moisture-activated adhesive, so that the mailer is more securely held together. As mentioned above, with reference to FIG. 2, when it is desired to open the mailer, the strips along the edge of the mailer may be ripped off along the perforations 26.

Figure 3:
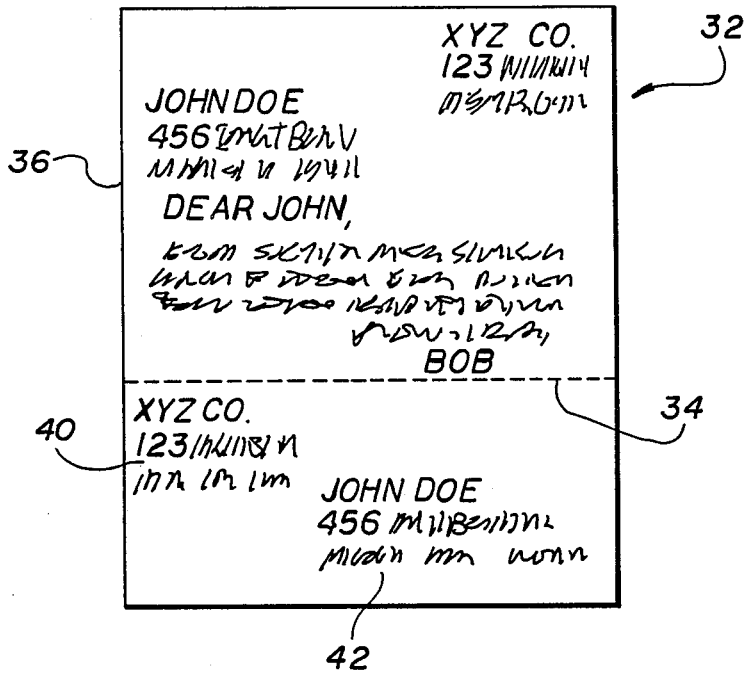
FIG. 3 is a front view of an alternative embodiment of the invention in which the upper part of the one piece mailer is available for the letter, and the lower portion is formed into an envelope.
Figure 4:
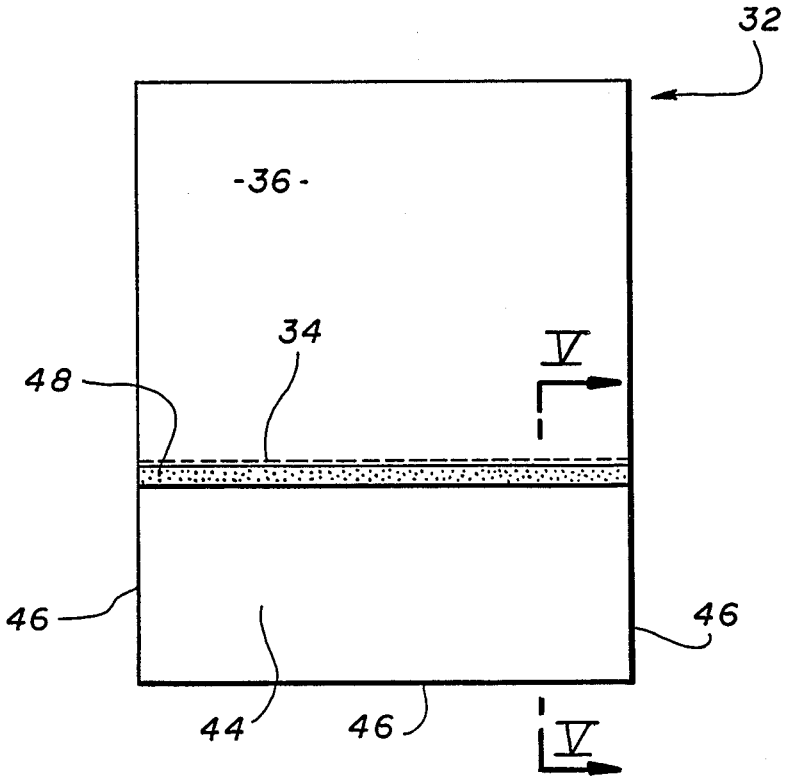
FIG. 4 is a rear view of the mailer of FIG. 3 showing the partial sheet and transverse adhesive strip which forms the envelope for the mailer.

Referring now to FIGS. 3 and 4 of the drawings, the two sides of another form of mailer 32 for use with laser printers is shown. The mailer of FIGS. 3 and 4 is divided into two areas by the transverse perforations 34. The upper portion 36 of the mailer is reserved for typing a letter or other communication to the addressee, and the lower portion 38 forms the front of an envelope, carrying the addresses of the sender at area 40, and of the addressee in area 42.

As may be seen in FIG. 4, showing the unprinted reverse side of the mailer, the lower section of the mailer is of double thickness, with an additional layer or partial sheet of paper 44 being permanently secured along three edges 46 to the back side of the lower section 38 of the sheet shown in FIG. 3. A strip of stable, water-activated adhesive 48 extends across the sheet 36 between the upper edge of the partial sheet 44, and the perforation line 34. Accordingly, when the letter or other communication has been printed, it may be removed from the envelope along the perforation line 34, folded, and inserted into the envelope formed by the lower portion of the mailer. The adhesive 48 is then moistened, and folded over to seal the envelope.

Incidentally, it may be noted that in both the case of the embodiment of FIGS. 1 and 2, and that of FIGS. 3 and 4, the laser printer or copier only prints on one side of the mailer. In addition, the leading edge of the mailer in both cases is a smooth single thickness leading edge of the sheet forming the upper portion of the mailer; and the windows in the case of FIGS. 1 and 2 or the double thickness in the case of FIGS. 3 and 4, and adhesive material, are on the trailing portion of the sheet as it passes through the laser printer or the copying machine, so that the possibility of jamming or malfunction of the laser printer or copier is minimized. Incidentally, in that regard, it has been found that, if windows are formed in the leading edge of material to be fed through a laser printer or copier, the probability of jamming is significantly increased.

Figure 5:
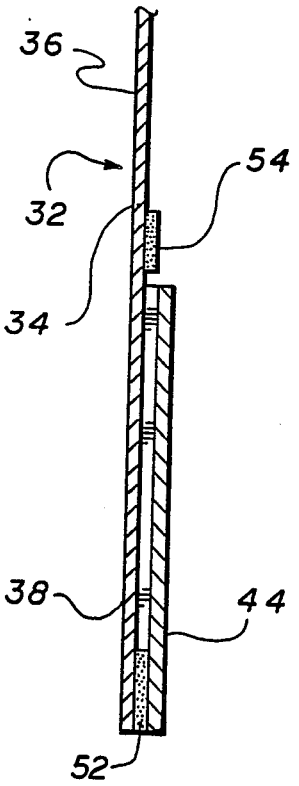
FIG. 5 is a cross-sectional view taken along lines V—V of FIG. 4.

FIG. 5 is a partial cross-sectional view taken along lines V—V of FIG. 4. It may also be noted that, in FIG. 5, the thickness of the layers of paper 36, 38 and 44 is exaggerated, as is the thickness of the permanent adhesive material 52 which extends around to partially close the envelope. The stable, moisture-activated adhesive strip 54 is also shown in FIG. 5 with an exaggerated thickness.

Figure 6:
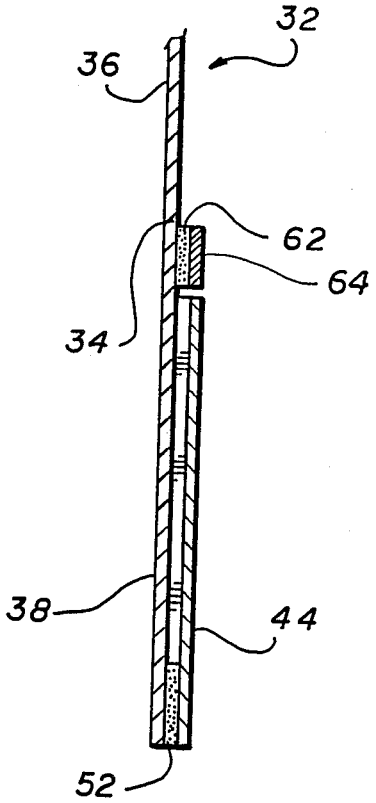
FIG. 6 shows an alternative embodiment of the invention in which pressure-sensitive adhesive is employed instead of stable water-activated adhesive.

FIG. 6 shows a slight modification as compared with the arrangement shown in FIG. 5. More specifically, instead of the stable moisture activated adhesive 54 as shown in FIG. 5, the embodiment of FIG. 6 discloses the use of a permanent, pressure-sensitive adhesive 62, covered by a thin strip of tape 64 which in turn has been coated by a release material such as silicone, on its inner surface so that it may be easily removed from the permanent, pressure-sensitive adhesive strip 62. It is also noted that the pressure-sensitive adhesive is preferably spaced back from the edge of the overlying strip by a millimeter or two of space, to avoid the possibility of flow of the pressure-sensitive adhesive is preferably spaced back from the edge of the overlying strip by a millimeter or two of space, to avoid the possibility of flow of the pressure-sensitive material when subject to heat. Following removal of the strip 64 and the separation of the envelope at the perforations 34, the flap is folded down over the outer partial sheet 44 to seal the envelope.

Figure 7:
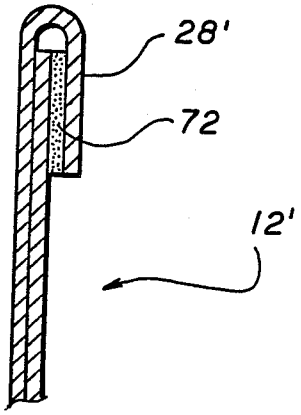
FIG. 7 shows an alternative sealing arrangement for the mailer of FIGS. 1 and 2, wherein the adhesive coated edge of the mailer folds over the upper edge of the mailer sheet.

In the arrangement of FIG. 1, it was disclosed that the gummed areas 28, 30, and 32 would engage the printed side of the upper portion of the mailer 12. An alternative arrangement is shown in FIG. 7 which shows the slightly modified mailer 12' being provided with the strip 28' folded over the upper edge of the mailer 12 with the inner strip of stable moisture activated adhesive being indicated at reference numeral 72 if FIG. 7 of the drawings. Of course, with the arrangement as shown in FIG. 7, a slight shifting of the relative positions of the windows and the zones in which the addresses appear, would be accomplished, and the line along which the strip 28' is to be folded would be slightly scored or perforated to facilitate folding.

Concerning the dimensions of the one piece mailers, it is clear that standard size envelopes are too small for handling by laser printers. Standard size paper such as $8\frac{1}{2}$ by 11 inches, to $8\frac{1}{2}$ by 14 and $8\frac{1}{2}$ by 17 inches can definitely be used. In addition, somewhat larger paper such as 11 by 17 inch paper may be used in larger types of laser printers; and paper as short as $8\frac{1}{2}$ inches wide by 6 inches long may be handled in standard laser printers.

In conclusion, it is to be understood that the foregoing detailed description and the accompanying drawings illustrate the preferred embodiments of the invention. However, various changes and modifications may be made without departing from the spirit and scope of the invention. Thus, by way of example and not of limitation, the stable, moisture-activated adhesive may be replaced by stable, pressure-sensitive material shielded by appropriate protective strips in each case. In addition, other forms of mailing arrangements wherein only one side of the sheet need be printed, and including the address and message on a single side of the sheet, may be employed. Accordingly, the present invention is not limited to the embodiments shown in the drawings or described in detail hereinabove.

What is claimed is:

1. A one-piece mailer for use with laser printers or copier machines, involving heating of the paper, comprising:

sheet paper means for receiving a printed message and for forming an envelope; said sheet paper means having an upper half and a lower half, and having dimensions of approximately 8½ inches by at least 11 inches, said sheet paper means constituting a single thickness continuous sheet of paper for its upper half;

printed message and address information printed on the front side only of said sheet paper means, with the message starting on the upper half of said sheet;

said sheet paper means including means for forming an envelope; and means for sealing said envelope including a stable, water-activated, adhesive which will not flow or become activated from the heat of a laser printer or a xerographic copier machine or from high humidity storage conditions.

2. A one-piece mailer as defined in claim 1 wherein the address and the message are both oriented right-side up on said mailer.

3. A one-piece mailer as defined in claim 1 wherein said water-activated adhesive is a polyvinyl emulsion.

4. A one-piece mailer for use with laser printers or copier machines involving heating of the paper, comprising:

sheet paper means for receiving a printed message and for forming an envelope; said sheet paper means having an upper half and a lower half, and having standard dimensions for laser printers or the like, such as approximately 8½ inches by at least 11 inches, said sheet paper means constituting a single thickness continuous sheet of paper for its upper half;

printed message and address information printed on one side only of said sheet paper means, with the message starting on the upper half of said sheet;

said sheet paper means including means for forming an envelope; and means for sealing said envelope including a stable adhesive which will not flow or become activated from the heat of a laser printer or a xerographic copier machine, or from high humidity storage conditions.

5. A one-piece mailer as defined in claim 4 wherein said mailer has marked areas for locating the name and address of the sender and the addresses on the upper portion thereof, and matching windows on the lower portion thereof.

6. A one-piece mailer as defined in claim 4 wherein the lower half of the back side of said mailer has partial sheet means secured thereto for forming an envelope, and wherein said adhesive extends in a strip across said sheet paper means and adjacent said partial sheet means, and said sheet paper means has perforations extending substantially across its width adjacent and above said strip of adhesive, to permit easy separation of said envelope from the remainder of the mailer.

7. A one-piece mailer as defined in claim 4 wherein the address and the message are both oriented right-side up on said mailer.

8. A one piece mailer as defined in claim 4 wherein said adhesive is a stable, water-activated adhesive which is not activated by a temperature of a few hundred degrees Fahrenheit, or by high humidity conditions.

9. A one-piece mailer as defined in claim 8 wherein said water-activated adhesive is a polyvinyl emulsion.

10. A one-piece mailer as defined in claim 4 wherein said adhesive is a stable pressure-sensitive adhesive, covered by a removable protective strip.

11. A one-piece mailer as defined in claim 10 wherein said pressure-sensitive adhesive is spaced back slightly from the edges of said protective strip and from the edge or edges of the mailer.

12. A one-piece mailer as defined in claim 10 wherein said pressure-sensitive adhesive is of the permanently adhering type.

13. A one-piece mailer for use with laser printers or copier machines involving heating of the paper, comprising:

sheet paper means for receiving a printed message and for forming an envelope; said sheet paper means having an upper half and a lower half, and having dimensions sufficiently large to be processed by standard types of laser printers without jamming, said sheet paper means constituting a single continuous sheet for its upper half;

printed message and address location areas being located on one side only of said sheet paper means, with the message to start on the upper half of said sheet;

said sheet paper means including means for forming an envelope; and means for sealing said envelope including stable, adhesive which will not flow or become activated from the heat of a laser printer or a xerographic copier machine, or from high humidity storage conditions.

14. A one-piece mailer as defined in claim 13 wherein said mailer has marked areas for locating the name and address of the sender and the addressee on the upper portion thereof, and matching windows on the lower portion thereof.

15. A one-piece mailer as defined in claim 13 wherein the lower half of the back side of said mailer has partial sheet means secured thereto for forming an envelope, and wherein said adhesive extends in a strip across said sheet paper means and adjacent said partial sheet means, and said sheet paper means has perforations extending substantially across its width adjacent and above said strip of adhesive, to permit easy separation of said envelope from the remainder of the mailer.

16. A one-piece mailer as defined in claim 13 wherein said adhesive is a stable, water-activated adhesive which is not activated by a temperature of a few hundred degrees Fahrenheit, or by high humidity conditions.

17. A one-piece mailer as defined in claim 13 wherein said adhesive is a stable pressuresensitive adhesive, covered by a removable protective strip.

18. A one-piece mailer as defined in claim 17 wherein said pressure-sensitive adhesive is spaced back slightly from the edges of said protective strip and from the edge or edges of the mailer.

19. A one-piece mailer for use with laser printers or copier machines, involving heating of the paper, comprising:

sheet paper means for receiving a printed message and for forming an envelope; said sheet paper means having an upper half and a lower half, and having dimensions of approximately 8½ inches by at least 11 inches, said sheet paper means constituting a single thickness continuous sheet of paper for its upper half.

printed message and address information printed on the front side only of said sheet paper means, with the message starting on the upper half of said sheet;

said sheet paper means including means for forming an envelope;

means for sealing said envelope including a stable, water-activated, adhesive which will not flow or become activated from the heat of a laser printer or a xerograhic copier machine or from high humidity stoage conditions; and said lower half of said sheet paper means including window means for exposing the names and addresses of the sender and the addressee of the mailer, and wherein the upper half of said sheet has marked areas in which the names and addresses of the sender and the addressee are to be printed, corresponding in location to the window locations, following folding of the mailer;

whereby said sheet paper means may be fed through a laser printer or a copier machine without jamming or contamination.

20. A one-piece mailer for use with laser printers or copier machines, involving heating of the paper, comprising:

sheet paper means for receiving a printed message and for forming an envelope; said sheet paper means having an upper half and a lower half, and having dimensions of approximately 8½ inches by at least 11 inches, said sheet paper means constituting a single thickness continuous sheet of paper for its upper half;

printed message and address information printed on the front side only of said sheet paper means, with the message starting on the upper half of said sheet;

said sheet paper means including means for forming an envelope;

means for sealing said envelope including a stable, water-activated, adhesive which will not flow or become activated from the heat of a laser printer of a xerographic copier machine or from high humidity storage conditions; and the lower half of the back side of said mailer having a partial sheet means secured thereto for forming an envelope, and wherein said adhesive extends in a strip across said sheet paper means and adjacent said partial sheet means, and said sheet means has perforations extending substantially across its width adjacent and above said strip of adhesive, to permit easy separation of said envelope from the remainder of the mailer;

whereby said sheet paper means may be fed through a laser printer or a copier machine without jamming or contamination.

21. A one-piece mailer for use with laser printers or copier machines, involving heating of the paper, comprising:

sheet paper means for receiving a printed message and for forming an envelope; said sheet paper means having an upper half and a lower half, and having dimensions of approximately 8½ inches by at least 11 inches, said sheet paper means constituting a single thickness continuous sheet of paper for its upper half;

printed message information printed on one side only of said sheet paper means, with the message starting on the upper half of said sheet;

said sheet paper means including means for forming an envelope; and means for sealing said envelope including a high temperature, stable adhesive which will not flow or become activated from the heat of a laser printer or a xerographic copier machine or from high humidity storage conditions.

* * * * *

US004784317B1

REEXAMINATION CERTIFICATE (2710th)

United States Patent [19] [11] B1 4,784,317

Chen et al. [45] Certificate Issued Oct. 31, 1995

[54] ONE PIECE MAILER FOR LASER PRINTER

[75] Inventors: Tien-Tsung Chen, Claremont; Ghanshyam H. Popat, Alta Loma; Stephanie A. Streeter, Pacific Palisades, all of Calif.

[73] Assignee: Avery International Corp., Pasadena, Calif.

Reexamination Request:
No. 90/003,541, Aug. 19, 1994

Reexamination Certificate for:

| | |
|---|---|
| Patent No.: | **4,784,317** |
| Issued: | **Nov. 15, 1988** |
| Appl. No.: | **64,074** |
| Filed: | **Jun. 17, 1987** |

[51] Int. Cl.[6] ..... B65D 27/04; B65D 27/14
[52] U.S. Cl. ..... 229/92.3; 229/70
[58] Field of Search ..... 229/70, 92.3

[56] References Cited

U.S. PATENT DOCUMENTS

| | | | |
|---|---|---|---|
| 658,344 | 9/1900 | Clawson . | |
| 2,759,658 | 1/1954 | Sawdon . | |
| 2,910,222 | 10/1959 | Bermingham et al. | 229/73 |
| 3,217,972 | 11/1965 | McNelis . | |
| 3,701,468 | 10/1972 | Steinhauser | 229/70 |
| 3,837,565 | 9/1974 | Johnsen | 229/68 R |
| 3,937,492 | 2/1976 | Biron | 282/25 |
| 4,335,845 | 6/1982 | Dierks et al. . | |
| 4,497,509 | 2/1985 | Gore . | |
| 4,668,211 | 5/1987 | Lubotta et al. | 493/188 |
| 4,951,864 | 8/1990 | Dicker | 229/80 |

*Primary Examiner*—Stephen P. Garbe

[57] ABSTRACT

A one piece mailer for use in laser printers or xerographic copying machines includes a standard size sheet which may be employed in laser printers or xerographic machines without special handling equipment and involves printing on one side only of the mailer. In addition, stable adhesive material is employed for sealing the one piece mailer which will not run or contaminate the office machines, when it is subject to several hundred degrees heat. This adhesive is preferably a water-activated adhesive other than natural gum (which is heat-activated). The first embodiment of the invention includes a mailing sheet having an upper and lower half, with the upper half carrying the addresses and the message, and the lower half having windows which match the location of the addresses on the upper half of the mailer. The second embodiment of the invention involves a mailer having a first full sheet having an upper portion on which the messages are printed, and a lower portion on which the addresses are printed. On the rear side of the main sheet is a short partial sheet toward the bottom of the main sheet forming an envelope, and with a transverse strip of adhesive immediately above the envelope pocket to seal the envelope. Perforations extend across the main sheet just above the adhesive-coated strip, so that the message section may be separated from the envelope portion, and the message portion folded and placed within the envelope, and the envelope sealed.

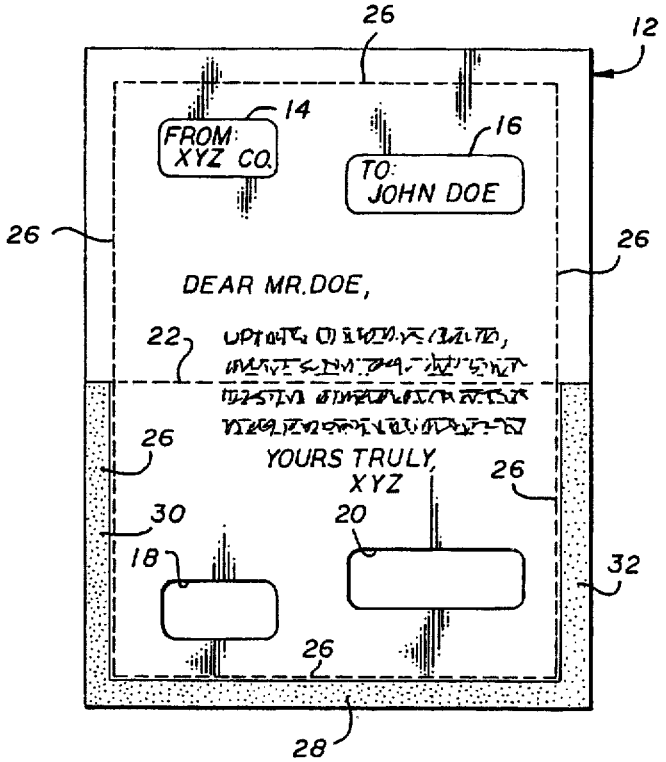

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–21 is confirmed.

New claims 22 and 23–32 are added and determined to be patentable.

*22. A one-piece mailer for use with laser printers or copier machines, involving the heating of the paper, comprising:*

*a sheet of paper for receiving a printed message, said sheet of paper having an upper half, a lower half and a front side, said upper half constituting a single thickness sheet that is free of cut-outs such as address windows, said sheet having dimensions sufficiently large to be processed by standard types of laser printers without jamming;*

*printed message and address information printed solely on the front side of said sheet of paper, with the message starting on the upper half of said sheet of paper and the address information being printed on the lower half of said sheet of paper;*

*said sheet of paper including an integral envelope having a stable, water-activated adhesive for sealing said envelope which will not flow or become activated from the heat of a laser printer or of a xerographic copier machine or from high humidity storage conditions;*

*said sheet of paper being free of cut-outs such as address windows;*

*wherein said adhesive extends in a transverse strip across said sheet of paper, and said sheet of paper has perforations extending substantially across its width adjacent to and substantially immediately above said transverse strip of adhesive, to permit easy separation of said envelope from the remainder of the mailer;*

*whereby said sheet of paper may be fed through a laser printer or a copier machine without jamming or contamination.*

*23. A mailer as defined in claim 22, wherein said upper half is free of adhesive.*

*24. A mailer as defined in claim 22, wherein the mailer has dimensions of at least approximately 8½ inches by 6 inches.*

*25. A one-piece mailer for use with laser printers or copier machines, involving heating of the paper, comprising:*

*sheet paper means for receiving a printed message and for forming an envelope, said sheet paper means having an upper half and a lower half, and having dimensions of approximately 8½ inches by at least 11 inches, said sheet paper means constituting a single thickness continuous sheet of paper for its upper half;*

*said sheet paper means having a front side and a back side;*

*laser printed message information that has been printed by a laser printer on the front side only of said sheet paper means, with the message starting on the upper half of said sheet, and with no laser printing on the back side of said sheet paper means;*

*said sheet paper means including an envelope having a front side and a back side;*

*laser printed address information that has been printed by a laser printer on the front side only of said envelope and said sheet paper means, with no laser printing on the back side of said envelope; and*

*means for sealing said envelope including a temperature-stable adhesive which will not flow or become activated from the heat of a laser printer or a xerographic copier machine or from high humidity storage conditions;*

*wherein said upper half is entirely free of open apertures, such as tractor feed holes, whereby said sheet paper means may pass through a laser printer without jamming.*

*26. A one-piece mailer as defined in claim 25, wherein said front side of said sheet paper means is entirely free of discontinuities other than perforations.*

*27. A one-piece mailer as defined in claim 25, wherein said lower half comprises a double thickness envelope body and an envelope flap, said lower half having a line of perforations extending transversely across said lower half adjacent said flap.*

*28. A one-piece mailer as defined in claim 25, wherein said upper half is entirely free of adhesive.*

*29. A one-piece mailer as defined in claim 25, wherein said sheet paper means substantially comprises a normal piece of correspondence paper separated by a transverse line of perforations from said means for forming an envelope.*

*30. A one-piece mailer as defined in claim 25, wherein said mailer has a single-thickness leading edge, said leading edge being smooth.*

*31. A one-piece mailer as defined in claim 25, wherein the edges of said sheet paper means are free of mechanical irregularities or discontinuities.*

*32. A one-piece mailer for use with laser printers or copier machines, involving heating of the paper, comprising:*

*sheet paper means for receiving a printed message and for forming an envelope, said sheet paper means having an upper half and a lower half, and having dimensions of approximately 8½ inches by at least 11 inches, said sheet paper means constituting a single thickness continuous sheet of paper for its upper half;*

*laser printed message and address information printed on the front side only of said sheet paper means, with the message starting on the upper half of said sheet, and with no laser printing on the back side of said sheet paper means;*

*said sheet paper means including means for forming an envelope; and*

*means for sealing said envelope including a stable, water-activated adhesive which will not flow or become activated from the heat of a laser printer or a xerographic copier machine or from high humidity storage conditions.*

* * * * *